US007006049B1

(12) United States Patent
Loane et al.

(10) Patent No.: US 7,006,049 B1
(45) Date of Patent: Feb. 28, 2006

(54) DUAL REFLECTOR SYSTEM AND METHOD FOR SYNTHESIZING SAME

(75) Inventors: Joseph T. Loane, San Francisco, CA (US); David R. Tanner, San Antonio, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/105,372

(22) Filed: Apr. 14, 2005

Related U.S. Application Data

(60) Provisional application No. 60/652,206, filed on Feb. 10, 2005.

(51) Int. Cl.
*H01Q 19/14* (2006.01)

(52) U.S. Cl. ..... 343/781 CA; 343/781 P; 343/779

(58) Field of Classification Search ..... 343/781 CA, 343/781 P, 781 R, 755, 757, 761, 779; H01Q 19/14
See application file for complete search history.

(56) References Cited

U.S. PATENT DOCUMENTS 3,795,004 A * 2/1974 Meek et al. ..... 343/761
4,484,197 A * 11/1984 Dragone ..... 343/781 P
6,160,520 A * 12/2000 Muhlhauser et al. ..... 343/755
6,618,093 B1 * 9/2003 Levy ..... 348/374

* cited by examiner

*Primary Examiner*—Hoanganh Le
(74) *Attorney, Agent, or Firm*—McDermott Will & Emery LLP

(57) ABSTRACT

In one embodiment of the present invention, an offset folded reflector pair is optimized for scanning off boresight by enforcing the Abbe Sine condition using a least-error approximation. Coma and astigmatism compare favorably over single reflector system and Gregorian pairs over a moderate field of view. A folded-pair reflector system of the present invention offers good performance in a compact size.

29 Claims, 4 Drawing Sheets

DUAL REFLECTOR SYSTEM AND METHOD FOR SYNTHESIZING SAME

CROSS-REFERENCES TO RELATED APPLICATION(S)

The present application claims the benefit of priority under 35 U.S.C. §119 from U.S. Provisional Patent Application Ser. No. 60/652,206 entitled "DUAL REFLECTOR SYSTEM AND METHOD FOR SYNTHESIZING SAME", filed on Feb. 10, 2005, the disclosure of which is hereby incorporated by reference in its entirety for all purposes.

STATEMENT AS TO RIGHTS TO INVENTIONS MADE UNDER FEDERALLY SPONSORED RESEARCH OR DEVELOPMENT

Not Applicable.

BACKGROUND OF THE INVENTION

The present invention generally relates to scanning antennas and more particularly a dual reflector design suited for scanning systems, including space-based systems.

A simple antenna scanning system uses a single paraboloidal reflector with a moveable or array feed to aim the beam over a desired field of view. Such systems are inherently disadvantageous due to the high optical aberration which causes beam degradation when scanning the beam at a moderate angle off axis.

A dual reflector design overcomes this problem by the use of a subreflector in conjunction with a primary reflector. An antenna feed is positioned so that it illuminates the subreflector. The subreflector is positioned to reflect the radiation to the primary reflector. The primary reflector then reflects the incident radiation as the desired beam. Again, a moveable or array feed is used to scan the beam off axis. The subreflector surface redirects the power from the feed to the aperture so as to correct much of the optical aberration (aperture phase error) when scanning off axis.

To design a scanned-beam dual reflector system, it is necessary to reduce optical aberration to acceptable levels. Coma, which results in a diffuse image of a point source, is a particularly troublesome aberration for beams scanned off boresight wherein the source is repositioned to effect scanning. Coma causes high sidelobes toward boresight near a scanned beam.

Conventional unblocked reflector systems include a single offset paraboloid with no correction for aberrations. Another conventional design is a coma-corrected Gregorian configuration. In a Gregorian reflector system, the reflector surfaces are not conic sections. A Gregorian configuration requires the focal array to be "vertically" placed behind the aperture, which may be undesirable for deployment.

Hence, it would be desirable to provide a compact dual reflector system that is suitable for use in spacecraft environments and earth-based applications where efficiency of packaging may be an important consideration.

SUMMARY OF THE INVENTION

A method for controlling a dual reflector antenna system is provided. In one embodiment, the dual reflector antenna system includes a main reflector, a subreflector and an aperture plane. In one exemplary aspect, the method is as follows. A number of reference points are determined including a source point, a subreflector reference point and a main reflector reference point. A total optical path is then determined using the reference points. The total optical path has a number of segments including a first segment measured from the source point to the subreflector, a second segment measured from the subreflector to the main reflector, and a third segment measured from the main reflector to the aperture plane. A ray field emanating from the source point is selected to generate a number of points to define a surface for the subreflector and a surface for the main reflector. A mapping function, such as the Abbe Sine condition, is then used to map the points to an outgoing ray field emanating from the main reflector. The subreflector surface is initialized. A number of incident vectors are determined, each incident vector being directed from the source point to a point of intersection on the subreflector surface. A reflected vector for each incident vector is then determined. A number of desired normal vectors are next computed using the incident vectors and the corresponding reflected vectors. An updated subreflector surface is computed using the desired normal vectors. The surface of the main reflector is then determined using the updated subreflector surface and the total optical path. When computing the updated subreflector surface using the desired normal vectors, an approximation error between the desired normal vectors and a number of actual normal vectors is evaluated. If the approximation error exceeds a minimum value, some of the foregoing steps are repeated using the updated subreflector surface.

In one exemplary implementation, the method of the present invention is performed by computer program code embodied in a computer-readable medium. The computer program code includes one or more instructions for performing a number of steps/tasks. A first step includes obtaining a subreflector surface. A second step includes obtaining a number of reference points including a source point, a main reflector reference point and a subreflector reference point. A third step includes obtaining a number of incident vectors. Each incident vector is directed from the source point to a point of intersection on the subreflector surface. A fourth step involves determining a total optical path. The total optical path has a number of segments including a first segment measured from the source point to the subreflector surface, a second segment measured from the subreflector surface to the main reflector surface, and a third segment measured from the main reflector surface to the aperture opening. A fifth step includes determining a reflected vector for each incident vector. In determining the reflected vector, an outgoing vector is determined based on the incident vector. The reflected vector is directed from the point of intersection on the subreflector surface corresponding to the incident vector to intersect the outgoing vector. A segment of the outgoing vector is determined from the point of intersection with the reflected vector to the aperture opening. The reflected vector is determined exclusive of Snell's Law of Reflection. A sixth step includes computing a number of desired normal vectors based on the incident vectors and the corresponding reflected vectors. A seventh step includes computing an updated subreflector surface based on the desired normal vectors. Finally, another step involves determining the surface of the main reflector based on the updated subreflector surface.

In one exemplary aspect, the computer program code further includes one or more instructions for computing a vector by applying the Abbe Sine condition to the incident vector.

By using the present invention, conditions with respect to coma and astigmatism are significantly improved. In one implementation, a folded pair provides for easier packaging and some fine pointing adjustment can also be made by mechanically tilting the nearly flat main reflector.

Reference to the remaining portions of the specification, including the drawings and claims, will realize other features and advantages of the present invention. Further features and advantages of the present invention, as well as the structure and operation of various embodiments of the present invention, are described in detail below with respect to accompanying drawings, like reference numbers indicate identical or functionally similar elements.

BRIEF DESCRIPTION OF THE DRAWINGS

Aspects, advantages and novel features of the present invention will become apparent from the following description of the invention presented in conjunction with the accompanying drawings.

DESCRIPTION OF THE SPECIFIC EMBODIMENTS

Figure 1:
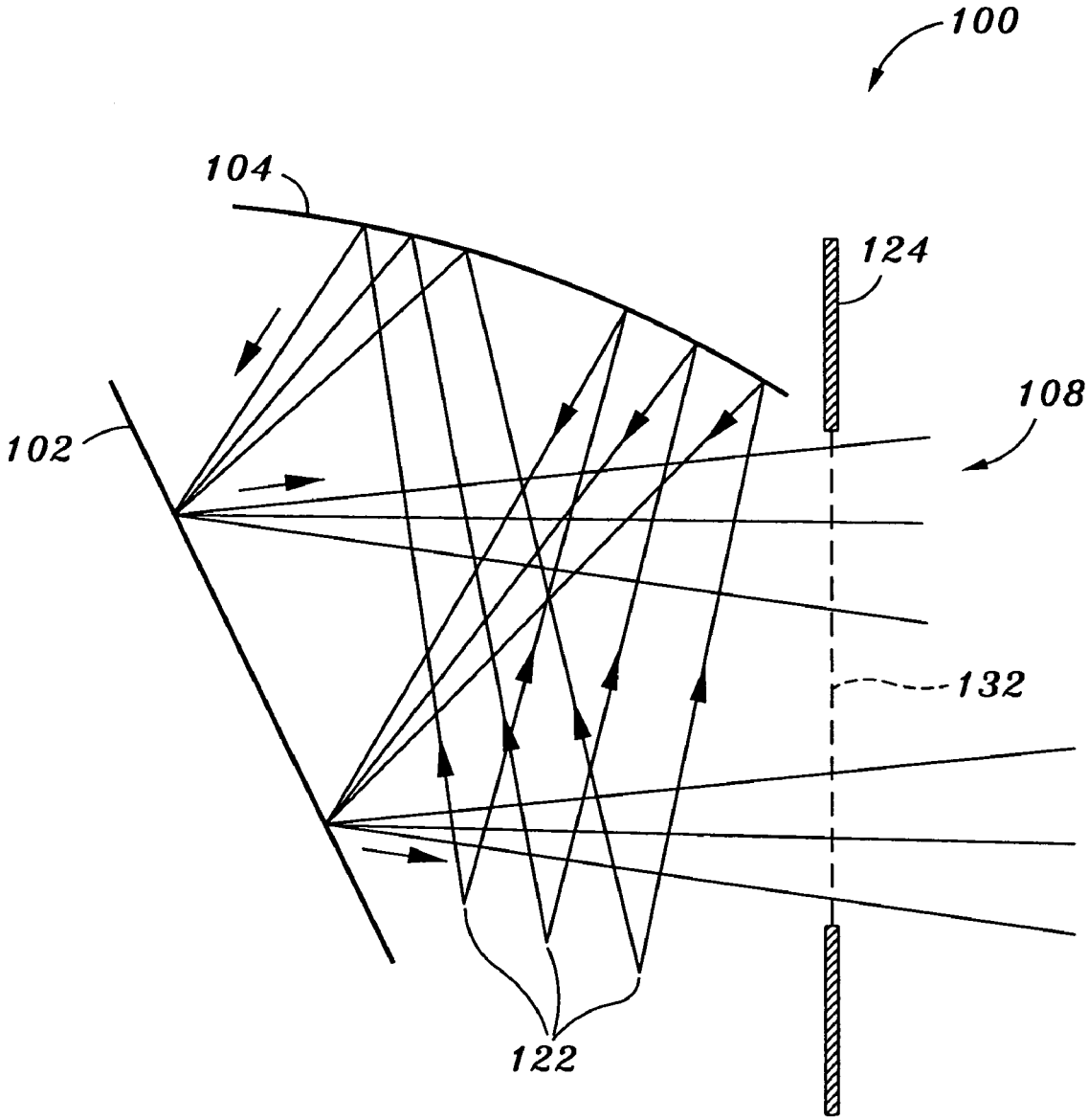
FIG. 1 shows a dual reflector antenna system according to one embodiment of the present invention.

The present invention in the form of one or more exemplary embodiments will now be described. FIG. 1 illustrates a dual reflector antenna system 100 configured according to various aspects of the present invention. The system 100 comprises a main reflector 102 and a subreflector 104. The surface of the main reflector 102 and the surface of the subreflector 104 are determined in accordance with the method further discussed below. One or more signal feeds 122 are provided to produce signals that are directed to the subreflector 104. The signals are reflected to the main reflector 102 and passed through an aperture plane 132 as a radiated signal 108.

The surfaces of the main reflector 102 and the subreflector 104, as determined according to the method below, have the desirable property of producing an optically corrected wavefront for a beam scanned over a field of view. It will be appreciated from the discussion below that the present invention is not limited to antennas of any particular size or range of sizes. For example, it is noted that typical microwave applications employ antennas on the order of 50 to a few hundred wavelengths. By "corrected," it is meant that the coma aberration is minimized over a finite range of tilted wavefronts corresponding to off-axis scanned beams.

Figure 2:
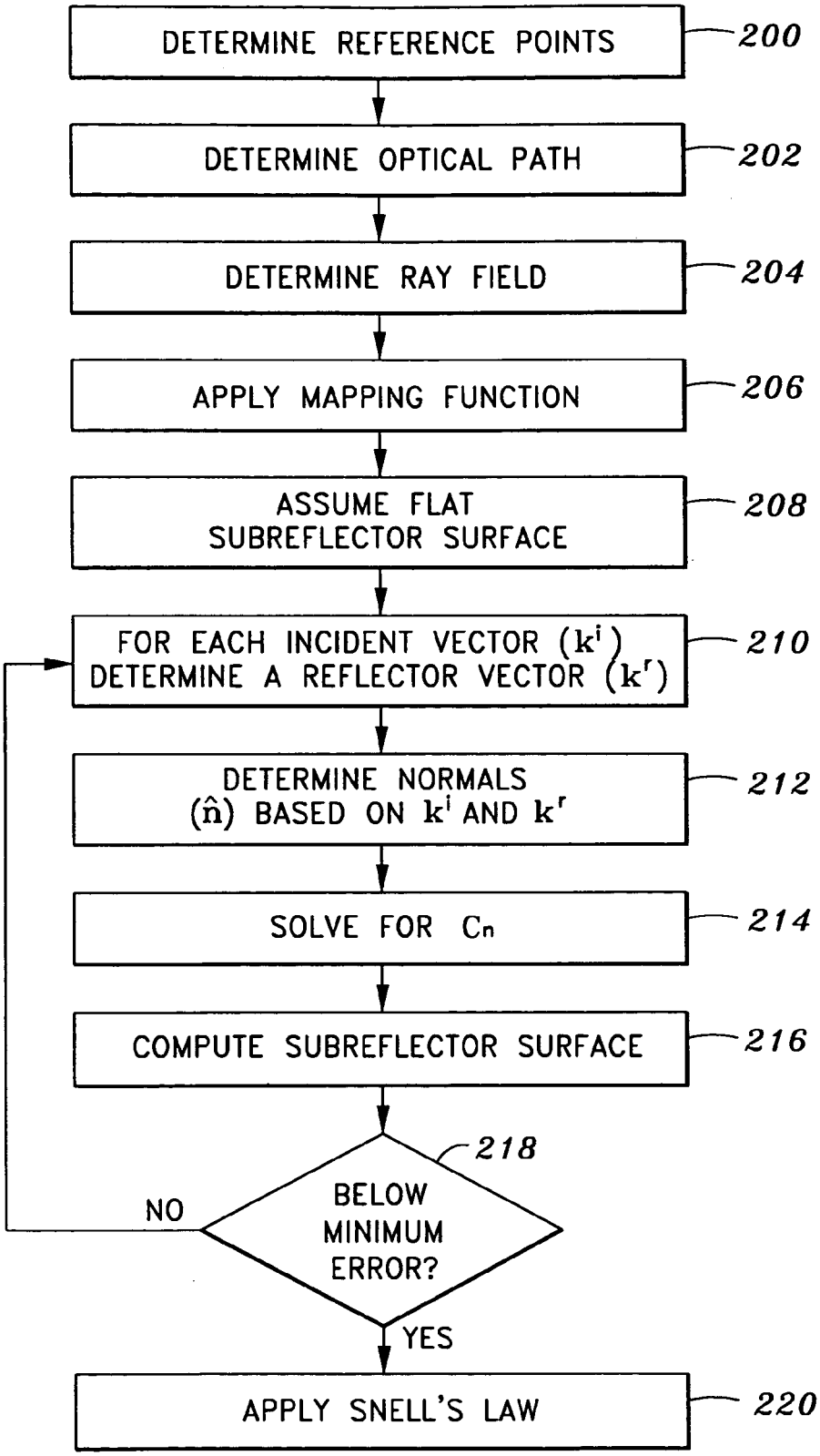
FIG. 2 is a high level flow diagram highlighting various aspects of the technique for making the main reflector and subreflector components of a dual reflector antenna system in accordance with one embodiment of the present invention.
Figure 3:
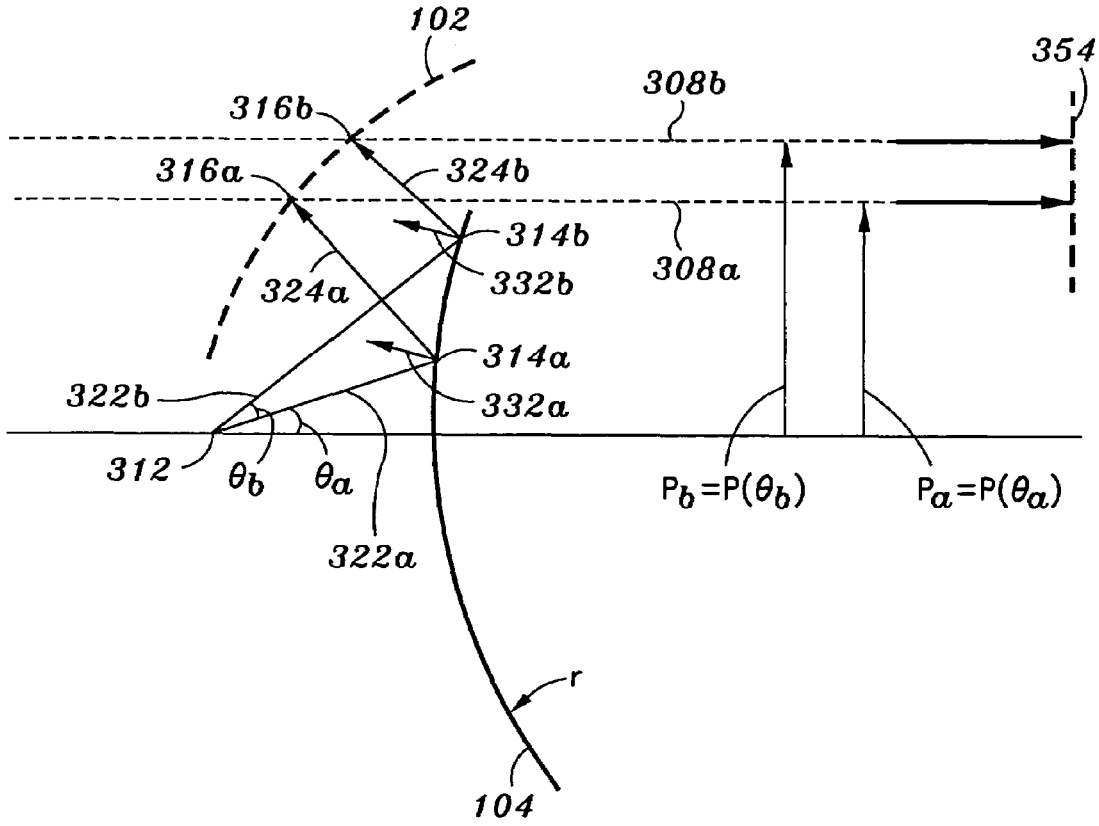
FIG. 3 illustrates a model for determining the subreflector surface and the main reflector surface according to one embodiment of the present invention.

FIG. 2 is a high level flow diagram of the processing that is performed for defining the surfaces of the main reflector 102 and the subreflector 104. As will be seen, the processing progresses in an iterative manner to gradually arrive at a desired surface shape for the subreflector 104 and for the main reflector 102. FIG. 3 shows a model illustrating the process of FIG. 2. Following is a discussion of the steps for defining the main reflector surface and the subreflector surface of a dual reflector antenna system according to one embodiment of the present invention.

With respect to FIG. 3, there is shown the main reflector 102 and the subreflector 104. A source point 312 is shown as being a source point for rays 322*a* and 322*b* in the greater "ray field." A line from the source point 312 to the "subreflector reference point" 314*a* can be thought of as a "center ray" 322*a*, which then becomes reflected ray 324*a* to the "main reflector reference point" 316*a*, and finally becomes ray 308*a* in the outgoing ray field, emerging at some location in the aperture plane 354. The other ray 322*b* progresses similarly to become ray 324*b* and ray 308*b* (parallel to 308*a*). The source point 312, subreflector reference points 314*a,b*, main reflector reference points 316*a,b*, and aperture plane 354 are kept fixed in the algorithm to provide a reference frame.

Generally, the subreflector surface is described by a position vector r expressed as a function of two independent variables u and v. In this particular implementation, the point r is expressed in a standard spherical coordinate system as a series involving independent variables $\theta$ and $\phi$.

Referring back to FIG. 2, the process for defining surfaces of the main reflector 102 and the subreflector 104 is further described in details below.

Step 1. At 200, the algorithm for synthesizing the reflector pair begins by obtaining initial reference points, including a source point 312, a reference point on the subreflector surface (the subreflector reference point 314*a*), and a reference point on the main reflector surface (the main reflector reference point 316*a*). A mapping function is used to provide a mapping of the ray field leaving the source point 312 into an outgoing ray field from the main reflector 102. The source point 312 and the two reflector reference points are chosen by the designer to constrain the overall geometry of the system. Based on the disclosure and teachings provided herein, it should be understood that a person of ordinary skill in the art will appreciate how to determine the source point and the reflector reference points.

In one implementation, the Abbe Sine condition is used to provide the mapping function. The Abbe Sine condition ensures minimum coma for small angular scan. This is represented simply as $\rho=R \sin \theta$ where R is a constant and $\theta$ is the angle between a reference direction and a ray from the source which maps to a radial coordinate $\rho$ in the aperture. The Abbe Sine condition also requires the azimuthal angle $\phi$ around the source reference direction to map to azimuthal angle $\Psi$ in the aperture as $\phi=\Psi+\text{constant}$. It can be appreciated of course that other mappings are possible.

Step 2. At 202, determine the total optical path from source point 312 along center rays 322*a*, 324*a*, and 308*a* to an arbitrarily positioned aperture plane 354. This is done by computing distances between fixed reference points and assuming center ray 308*a* to be normal to the aperture plane 354. Snell's Law of Reflection is not used here.

Step 3. At 204, select a set of ray-field directions $(\theta, \phi)$ from the source point 312 to produce enough points to numerically define both the main reflector 102 and the subreflector 104. The number of points and their distribution depends upon the iterative convergence of the algorithm and the number of functions in the series expression for the subreflector point r. Each subreflector point determines one main reflector point. Typically a couple of hundred points are generated for each surface.

Step 4. At 206, for each $(\theta, \phi)$, apply the mapping function to determine the aperture coordinates $(\rho, \Psi)$ of the corresponding outgoing ray. All outgoing rays are parallel to ray 308*a* since they are all normal to the aperture plane 354. As mentioned above, a typical embodiment might use the Abbe Sine condition as the mapping function.

Step 5. At 208, the subreflector surface is initialized for subsequent iterations. The subreflector 104 shown in FIG. 3 represents a subreflector whose surface is defined by position vector r. The initial surface of the subreflector 104 can be any reasonable shape. In one illustrative implementation, the starting surface is flat, titled to redirect the center ray 322*a* toward the main reflector as reflected ray 324*a*.

Step 6. At 210, let ray 322*b* and point 314*b* represent any incident vector $k^i$ and corresponding subreflector point r defined in the set of directions (θ, ϕ). For each (θ, ϕ), find an endpoint 316*b* for reflected vector $k^r$ (ray 324*b*) by adjusting the endpoint's location along ray 308*b* (parallel to 308*a*) so that the path length from source point 312 to aperture plane 354 is equal to the total optical path from Step 2 at 202. Snell's Law of Reflection is not used in Step 6.

Step 7. At 212, for each reflection point r, construct a desired normal vector n (332*b* in FIG. 3) by bisecting the angle formed by vectors $k^r$ and $(-)k^i$. These normals are fictitious in the sense that they are not necessarily normal to the subreflector surface described by the set of points r.

Step 8. At 214, using all normals n computed over the set of directions (θ, ϕ), solve for the coefficients $c_n$ which express r as a series involving function of θ and ϕ. The details of this procedure are further described below.

Step 9. At 216, compute the subreflector points r over the set of directions (θ, ϕ). Evaluate the approximation error between the desired normals n and the actual surface normals. If the approximation error is too large, at 218, feed the new subreflector surface back into Step 6 at 210 for recalculation. Repeat Steps 6 through 9 (at 210–216) until the approximation error reaches a minimum. A good approximation of all normals over (θ, ϕ) ensures a good approximation of the power distribution in the mapping.

Step 10. At 220, use Snell's Law of Reflection at the subreflector and the path length along $k^i$ and $k^r$ to generate points on the main reflector 102. The total path constraint uniquely determines the main-reflector point along $k^r$ to ensure exact phase, which is more important than exact aperture amplitude distribution for most applications. When all optical paths from the source point 312 to the aperture 354 are equal, the outgoing wavefront at the aperture 354 originating from the source point 312 (unscanned case) is perfectly flat.

Calculation of the coefficients $c_n$ as mentioned above in Step 8 at 214 is further described as follows. Each incident vector $k^i$ (322*a*, 322*b*) and its corresponding reflection vector $k^r$ (324*a*, 324*b*) are constrained by the relationship shown below in Eqns. 1 as follows, where n̂ is the unit normal (332*a*, 332*b*, in Step 7) to the subreflector surface described by r:

$$\hat{n}\cdot r_\theta=0$$

$$\hat{n}\cdot r_\phi=0$$

where $$n=\hat{k}^r-\hat{k}^i$$

$$\hat{n}=n/|n| \qquad \text{Eqns. 1}$$

Partial derivatives $r_\theta$ and $r_\phi$ of r are tangent to the surface, so their dot products with n̂ must be zero. As shown in the equations, we use the convention where subscripts denote partial derivatives. Also, carets normalize vectors to make them unit vectors: note that $\hat{r}=\hat{k}^i$.

Generally, the vector r is denoted in boldface and defined as the unit vector r̂ times the magnitude r of the vector r:

$$r=\hat{r}r$$

where $$\hat{r}=\hat{r}(\theta,\phi) \text{ and } r=r(\theta,\phi) \qquad \text{Eqn. 1A}$$

Thus, the vector $r_\theta$ which represents the partial derivative of r with respect to θ is defined by:

$$r_\theta=\hat{r}_\theta r+\hat{r}r_\theta \qquad \text{Eqn. 1 B}$$

While the vector $r_\phi$ which represents the partial derivative of r with respect to ϕ is defined by:

$$r_\phi=\hat{r}_\phi r+\hat{r}r_\phi \qquad \text{Eqn. 1 C}$$

Thus, Eqn. 1 can be rewritten by substituting Eqns. 1B and 1C to produce:

$$\hat{n}\cdot(\hat{r}_\theta r+\hat{r}r_\theta)=0$$

$$\hat{n}\cdot(\hat{r}_\phi r+\hat{r}r_\phi)=0 \qquad \text{Eqns. 2}$$

In the case where (r,θ,ϕ) are standard spherical coordinates, $(\hat{r},\hat{\theta},\hat{\phi})$ represent unit vectors and Eqns. 2 can be rewritten as Eqns. 3A and 3B.

$$\hat{n}\cdot(\hat{\theta}r+\hat{r}r_\theta)=0, \qquad \text{Eqn. 3A}$$

$$\hat{n}\cdot(\hat{\phi}\sin\theta r+\hat{r}r_\phi)=0; \qquad \text{Eqn. 3B}$$

$$\hat{r}_\theta=\hat{\theta}$$

where $$\hat{r}_\phi=\hat{\phi}\,\theta$$

Eqn. 4A below defines the target surface r of the subreflector 104, where it is understood that $r_n=r_n(\theta,\phi)$. Eqn. 4 is a conventional simplified representation of Eqn. 4A. It is convenient to define $r_o$ along the center ray 322*a* leaving the source point 312. Eqns. 5 represent the partial derivatives of Eqn. 4.

$$\text{Let } r=r_0+\Sigma r_n c_n \qquad \text{Eqn. 4A}$$

where $r_0$=constant $$r=r_0+\langle rc\rangle \qquad \text{Eqn. 4}$$

$$\text{also } r_\theta=\langle r_\theta c\rangle \text{ and } r_\phi=\langle r_\phi c\rangle \qquad \text{Eqns. 5}$$

Here bracket notation denotes a matrix row-column product (scalar).

Eqn. 6A results from the substitution of Eqns. 5 into Eqn. 3A, and similarly, Eqn. 6B results from substitution of Eqns. 5 into Eqn. 3B; where the normal vectors were computed according to Eqns. 1. Then, in Step 8 at 214, a next iteration of the target surface of the subreflector 104 is determined by solving Eqns. 6A and 6B to obtain an approximate solution for $c_n$. In special cases, these two equations can be solved exactly, but in general they can be solved for $c_n$ in a least-error sense. Since they are linear, a method such as singular-value decomposition can be used. Choosing two times the number of points to be greater than the number of unknown coefficients $c_n$ results in an overdetermined linear system. Of course, it can be appreciated that other known techniques for linear systems can be applied.

$$[\hat{n}\cdot\hat{\theta}\langle r+\hat{n}\cdot\hat{r}\langle r_{74}]c\rangle=-\hat{n}\cdot\hat{\theta}r_0 \qquad \text{Eqn.6A}$$

$$[\hat{n}\cdot\hat{\phi}\sin\theta\langle r+\hat{n}\cdot\hat{r}\langle r_\phi]c\rangle=-\hat{n}\cdot\hat{\phi}\sin\theta r_0 \qquad \text{Eqn.6B}$$

In Step 9, at 216, an approximation error is determined when solving the system of equations represented by Eqns. 6A and 6B to obtain a solution for $c_n$. If it has been determined (in Step 9) that this approximation error has not converged to a "minimum" error value, then a newly computed subreflector surface r is used in the next iteration starting from Step 6 at 210. The mathematical norm of the residual defined for a linear system would be one example of the approximation error being monitored, but other error criteria are possible.

Figure 4:
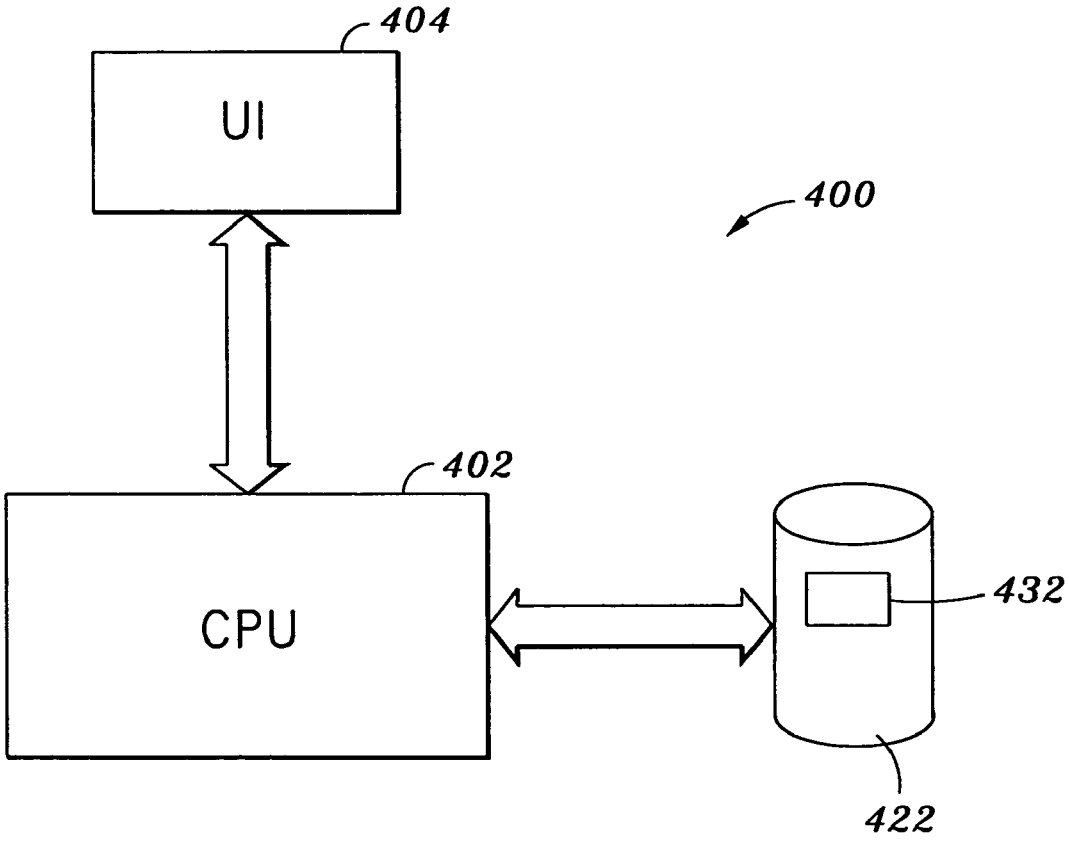
FIG. 4 shows a generalized computing system incorporating aspects of the present invention.

FIG. 4 schematically shows an illustrative embodiment of a data processing system 400 configured according to the present invention. The data processing system 400 comprises a data processing component 402. This is typically a computer device such as a desktop personal computer (PC), a laptop device, or the like. It can be appreciated that conventional hardware and software components are included, such as a central processing unit (CPU), suitable memory (e.g., RAM, ROM), mass storage capability (e.g., hard disk drive, network based storage, and so on), input devices (e.g., mouse, keyboard, input tablet, etc.), and output device such as a video display or the like. Appropriate software is also understood to be provided; e.g., operating system (OS) and the like.

The data processing system 400 also includes a user interface (UI) component 404. This is an abstract representation, so the UI component is not tied to a particular aspect of the system. Generally, all interactions with the data processing system 400 is by way of a combination of hardware and software. Each software component provides some form of user interface for the user. The UI 404 is intended to represent a variety of user interfaces.

A storage device 422 is shown having stored therein computer program code 432. The storage device 422 can be an internal hard drive in the data processing component 402, or a floppy disk drive, or a CD drive. The computer program code 432 can be an executable program that is stored on the storage device 422 and is executable by a user.

The computer program code 432 is configured to perform according to the flow chart shown in FIG. 2 and generally as described above and represents one implementation of the method of the present invention. The computer program code 432 can be used by the user (e.g., via the UI component 404) to determine the reference points, such as the source reference point 312 (FIG. 3), the subreflector reference point 314*a*, and the main reflector reference point 316*a*. Similarly, the computer program code 432 can be used by the user to obtain a suitable ray field which defines the set of incident rays $k_i$ for the iteration. Also, some threshold criterion can be obtained from the user which specifies the termination conditions for the iterative processing.

It should be understood that the present invention as described above can be implemented in software, hardware, or a combination of both, in the form of control logic in a modular or integrated manner. Based on the disclosure and teachings provided herein, a person of ordinary skill in the art will appreciate other ways and/or methods to implement the present invention.

The above description is illustrative but not restrictive. Many variations of the present invention will become apparent to those skilled in the art upon review of the disclosure. The scope of the present invention should, therefore, be determined not with reference to the above description, but instead should be determined with reference to the pending claims along with their full scope or equivalents.

What is claimed is:

1. A method for controlling a dual reflector antenna system, the dual reflector antenna system having a main reflector, a subreflector and an aperture plane, the method comprising:

(a) determining a plurality of reference points including a source point, a subreflector reference point and a main reflector reference point;

(b) determining a total optical path using the plurality of reference points, the total optical path having a plurality of segments, the plurality of segments including a first segment measured from the source point to the subreflector, a second segment measured from the subreflector to the main reflector, and a third segment measured from the main reflector to the aperture plane;

(c) selecting a ray field emanating from the source point to generate a plurality of points to define a surface for the subreflector and a surface for the main reflector;

(d) using a mapping function to map the plurality of points to an outgoing ray field emanating from the main reflector;

(e) initializing the subreflector surface;

(f) obtaining a plurality of incident vectors, each incident vector being directed from the source point to a point of intersection on the subreflector surface;

(g) determining a reflected vector for each incident vector;

(h) determining a plurality of desired normal vectors using the plurality of incident vectors and the corresponding reflected vectors;

(i) computing an updated subreflector surface using the plurality of desired normal vectors; and (j) determining the surface of the main reflector using the updated subreflector surface and the total optical path.

2. The method of claim 1 wherein the mapping function is the Abbe Sine condition.

3. The method of claim 1 wherein the third segment of the total optical path is normal to the aperture plane.

4. The method of claim 1 wherein a point on the subreflector surface corresponds to a point on the main reflector surface.

5. The method of claim 1 wherein when determining the total optical path, Snell's Law of Reflection is not used.

6. The method of claim 1 wherein the subreflector surface is initialized to be flat.

7. The method of claim 1 wherein for each incident vector, the corresponding reflected vector is calculated using the total optical path.

8. The method of claim 7 wherein for each incident vector, the corresponding reflector vector is calculated without using Snell's Law of Reflection.

9. The method of claim 1 wherein the Snell's Law of Reflection is used when determining the surface of the main reflector using the updated subreflector surface and the total optical path.

10. The method of claim 1 wherein computing an updated subreflector surface using the plurality of desired normal vectors further comprises:

evaluating an approximation error between the plurality of desired normal vectors and a plurality of actual normal vectors; and if the approximation error exceeds a minimum value, repeating steps (f) through (i) using the updated subreflector surface.

11. Computer program code embodied in a computer-readable medium, the computer program code having logic configured to perform the method as recited in claim 1.

12. For a dual reflector antenna system having a main reflector, a subreflector and an aperture opening, a method for determining a surface of the main reflector, the method comprising:

(a) obtaining a subreflector surface;

(b) obtaining a plurality of reference points including a source point, a main reflector reference point and a subreflector reference point;

(c) obtaining a plurality of incident vectors, each incident vector being directed from the source point to a point of intersection on the subreflector surface;

(d) determining a total optical path having a plurality of segments, the plurality of segments including a first segment measured from the source point to the subreflector surface, a second segment measured from the subreflector surface to the main reflector surface, and a third segment measured from the main reflector surface to the aperture opening;

(e) determining a reflected vector for each incident vector, comprising steps of:

determining an outgoing vector based on the incident vector; and determining the reflected vector, wherein the reflected vector is directed from the point of intersection on the subreflector surface corresponding to the incident vector to intersect the outgoing vector, and determining a segment of the outgoing vector from the point of intersection with the reflected vector to the aperture opening, wherein the reflected vector is determined exclusive of Snell's Law of Reflection;

(f) computing a plurality of desired normal vectors based on the plurality of incident vectors and the corresponding reflected vectors;

(g) based on the plurality of desired normal vectors, computing an updated subreflector surface; and (h) determining the surface of the main reflector based on the updated subreflector surface.

13. The method of claim 12 wherein the step of determining the outgoing vector includes computing a vector by applying the Abbe Sine condition to the incident vector.

14. The method of claim 12 wherein the third segment of the total optical path is normal to the aperture opening.

15. The method of claim 12 wherein a point on the subreflector surface corresponds to a point on the main reflector surface.

16. The method of claim 12 wherein for each incident vector, the corresponding reflected vector is calculated using the total optical path.

17. The method of claim 12 wherein the Snell's Law of Reflection is used when determining the surface of the main reflector based on the updated subreflector surface.

18. The method of claim 12 wherein computing an updated subreflector surface based on the plurality of desired normal vectors further comprises:

evaluating an approximation error between the plurality of desired normal vectors and a plurality of actual normal vectors; and if the approximation error exceeds a minimum value, repeating steps (e)-(h) using the updated subreflector surface.

19. Computer program code embodied in a computer-readable medium, the computer program code having logic configured to perform the method as recited in claim 12.

20. Computer program code embodied in a computer-readable medium, the computer program code having a plurality of instructions for controlling a dual reflector antenna system, the dual reflector antenna system having a main reflector, a subreflector and an aperture plane, the plurality of instructions comprising:

one or more instructions for determining a plurality of reference points including a source point, a subreflector reference point and a main reflector reference point;

one or more instructions for determining a total optical path using the plurality of reference points, the total optical path having a plurality of segments, the plurality of segments including a first segment measured from the source point to the subreflector, a second segment measured from the subreflector to the main reflector, and a third segment measured from the main reflector to the aperture plane;

one or more instructions for selecting a ray field emanating from the source point to generate a plurality of points to define a surface for the subreflector and a surface for the main reflector;

one or more instructions for using a mapping function to map the plurality of points to an outgoing ray field emanating from the main reflector;

one or more instructions for initializing the subreflector surface;

one or more instructions for obtaining a plurality of incident vectors, each incident vector being directed from the source point to a point of intersection on the subreflector surface;

one or more instructions for determining a reflected vector for each incident vector;

one or more instructions for determining a plurality of desired normal vectors using the plurality of incident vectors and the corresponding reflected vectors;

one or more instructions for computing an updated subreflector surface using the plurality of desired normal vectors; and one or more instructions for determining the surface of the main reflector using the updated subreflector surface and the total optical path.

21. The computer program code of claim 20 wherein the mapping function is the Abbe Sine condition.

22. The computer program code of claim 20 wherein the third segment of the total optical path is normal to the aperture plane.

23. The computer program code of claim 20 wherein a point on the subreflector surface corresponds to a point on the main reflector surface.

24. The computer program code of claim 20 wherein Snell's Law of Reflection is not used in the one or more instructions for determining the total optical path.

25. The computer program code of claim 20 wherein the subreflector surface is initialized to be flat.

26. The computer program code of claim 20 wherein for each incident vector, the corresponding reflected vector is calculated using the total optical path.

27. The computer program code of claim 26 wherein for each incident vector, the corresponding reflector vector is calculated without using Snell's Law of Reflection.

28. The computer program code of claim 20 wherein the Snell's Law of Reflection is used in the one or more instructions for determining the surface of the main reflector using the updated subreflector surface and the total optical path.

29. The computer program code of claim 20 wherein the one or more instructions for computing an updated subreflector surface using the plurality of desired normal vectors further comprises:

one or more instructions for evaluating an approximation error between the plurality of desired normal vectors and a plurality of actual normal vectors; and one or more instructions for recomputing the updated subreflector surface if the approximation error exceeds a minimum value.

* * * * *

UNITED STATES PATENT AND TRADEMARK OFFICE

CERTIFICATE OF CORRECTION

PATENT NO. : 7,006,049 B1
APPLICATION NO. : 11/105372
DATED : February 28, 2006
INVENTOR(S) : Joseph T. Loane et al.

It is certified that error appears in the above-identified patent and that said Letters Patent is hereby corrected as shown below:

Column 6, lines 28 and 30 are transposed. Specifically,

" $\hat{r}_\theta = \hat{\theta}$ -- where should read where " $\hat{r}_\theta = \hat{\theta}$ --; and Column 6, line 62, in the middle of Eqn.6A, "$r_{74}$]c" should read --$r_\theta$]c--.

Signed and Sealed this

Seventh Day of November, 2006

JON W. DUDAS
*Director of the United States Patent and Trademark Office*